United States Patent [19]

Mullay

[11] Patent Number: 4,872,929

[45] Date of Patent: Oct. 10, 1989

[54] COMPOSITE EXPLOSIVE UTILIZING WATER-SOLUBLE FUELS

[75] Inventor: John J. Mullay, Hazeltown, Pa.

[73] Assignee: Atlas Powder Company, Dallas, Tex.

[21] Appl. No.: 237,773

[22] Filed: Aug. 29, 1988

[51] Int. Cl.[4] ..... C06G 31/28

[52] U.S. Cl. ..... 149/46; 149/2; 149/61

[58] Field of Search ..... 149/2, 44, 61

[56] References Cited

U.S. PATENT DOCUMENTS

| | | | |
|---|---|---|---|
| 3,161,551 | 12/1964 | Egly et al. | 149/46 |
| 3,447,978 | 6/1969 | Bluhm | 149/2 |
| 3,764,421 | 10/1973 | Clark | 149/46 |
| 4,111,727 | 9/1978 | Clay | 149/2 |
| 4,141,767 | 2/1979 | Sudweeks et al. | 149/2 |
| 4,181,546 | 1/1980 | Clay | 149/21 |
| 4,294,633 | 10/1981 | Clay | 149/2 |
| 4,310,364 | 1/1982 | Ekman et al. | 149/2 |
| 4,338,146 | 7/1982 | Granlund | 149/109.6 |
| 4,386,977 | 6/1983 | Ikeda et al. | 149/2 |
| 4,428,789 | 1/1984 | Jessop et al. | 149/2 |
| 4,448,619 | 5/1984 | Mitchell | 149/2 |
| 4,500,369 | 2/1985 | Tag et al. | 149/2 |
| 4,509,998 | 4/1985 | Hajto | 149/2 |
| 4,555,278 | 11/1985 | Cescon et al. | 149/21 |
| 4,585,495 | 4/1986 | Honeyman et al. | 149/2 |
| 4,594,118 | 6/1986 | Curtin et al. | 149/2 |
| 4,676,849 | 6/1987 | Curtin et al. | 149/2 |
| 4,678,524 | 7/1987 | Cranney et al. | 149/2 |
| 4,764,230 | 8/1988 | Bates et al. | 149/2 |
| 4,784,706 | 11/1988 | McKenzie | 149/2 |

FOREIGN PATENT DOCUMENTS 281537 3/1968 Australia .

OTHER PUBLICATIONS

"The Use of Surface Active Agents to Sensitize AN/FO Mixtures", by R. W. Coxon of Australian Institute of Mining and Metallurgy.

"Amonium Nitrate Explosives Some Experimental Mixes", by R. W. Coxon of Australian Institute of Mining and Metallurgy.

*Primary Examiner*—Stephen J. Lechert, Jr.

*Attorney, Agent, or Firm*—Richards, Harris, Medlock & Andrews

[57] ABSTRACT

Disclosed is an explosive composition formed by a mixture of solid oxidizer salt and emulsion. In one aspect the emulsion contains no dissolved inorganic oxidizer salts in the aqueous phase. In another embodiment the emulsion contains an aqueous solution of less than a 75% saturated solution of oxidizer salt dissolved in the aqueous phase.

9 Claims, No Drawings

COMPOSITE EXPLOSIVE UTILIZING WATER-SOLUBLE FUELS

TECHNICAL FIELD

The present invention relates to composite explosives combining a solid oxidizer or ANFO with a stable emulsion. In particular, the invention relates to the use of water soluble fuels in the formation of the aqueous phase of a water-in-oil emulsion suitable for preparation of the composite explosive mixture.

BACKGROUND OF THE INVENTION

The present invention relates to an economical composite explosive with good bulk strength. More particularly, in one aspect the invention relates to a combination of an emulsion containing a water soluble fuel and an aqueous phase which contains no dissolved oxidizer salts with particulate ammonium nitrate or ANFO to achieve a dense composite explosive. In another aspect the invention utilizes an emulsion having water soluble fuels and an unsaturated aqueous solution of dissolved oxidizer salts as the discontinuous phase of the emulsion component.

It has been common practice in the explosive art to utilize oxidizer solutions which contain the maximum amount of oxidizer possible, i.e., the highest possible oxidizer to water ratio. This served a dual purpose. First it provided for a maximum energy on a weight basis. This is because water essentially acts like an energy sink. Second it was believed to be necessary to provide the greatest sensitivity to initiation.

This point of view has been carried over the blends of emulsions with solid AN or ANFO since it represented the common wisdom. However, maximizing oxidizer causes several difficulties. First it adds cost to the final explosive in terms of raw materials. Second it requires the explosive manufacturer to have facilities that are capable of handling oxidizer solutions at relatively high temperatures. This of course creates safety as well as economic and logistic difficulties. This second problem can be partially rectified by the use of calcium nitrate or sodium nitrate to lower the crystal point of the oxidizer. These ingredients of course represent additional oxidizer salts and correspondingly increased cost.

Contrary to the current practice, it has been found that the use of oxidizer salts in the emulsion portions of the blend can be minimized and still result in a product with a high energy and good sensitivity to initiation. This allows the use of low a crystal point and essentially oxidizer free aqueous solutions to be used as the internal phase of the emulsion protion of the emulsion/solid oxidizer product.

The explosive industry has continuously sought inexpensive and easy to handle explosive mixtures. Mixtures of ammonium nitrate and diesel fuel have been used for many years in the explosive industry to produce ANFO. ANFO currently is typically a blend of ammonium nitrate ("AN") in prill form mixed with diesel fuel oil ("FO") in a ratio of about 94% AN to 6% FO. ANFO is inexpensive and is widely used in various kinds of blasting, but its relatively low bulk density (about 0.8 gm/cc) limits the amounts of useful energy that can be obtained in the borehole. Further, ANFO suffers the disadvantage that it becomes desensitized by water, precluding its use in water filled boreholes.

The industry has made various attempts to increase the bulk strength of ANFO to thereby provide more energy per unit of volume. One method attempted was to increase the density of ammonium nitrate by using ground ammonium nitrate rather than prills. Another attempt was use of a high density additive fuel to the ANFO, such as ferrophosphorus. U.S. Pat. No. 3,764,421 describes an attempt to increase the density of ANFO by addition of a controlled amount of water and aging the mixture for a number of days to soften the ANFO, followed by mixing of the ANFO after aging to break it down into finely-divided solids.

Australian Pat. No. 281,537 describes explosives using ammonium nitrate prills mixed with an emulsion formed from oil, water and a surface active agent or emulsifier. This was an attempt to improve the sensitivity of ANFO by adding a small amount of water to the ammonium nitrate and distributing with oil in the form of an emulsion over the ammonium nitrate. This was proposed in order to better distribute the water and oil over the prill and for the intended purpose the emulsion did not need to be stable.

To provide a waterproof product the explosive industry developed water-in-oil emulsions, such as disclosed in U.S. Pat. No. 3,447,978. The water-in-oil emulsion formed contained a saturated aqueous solution of oxidizing salts which form the discontinuous phase of the emulsion. The emulsion contained an occluded gas component to lower the density of the emulsion to render it detonable.

Solid oxidizer salts or ANFO have also been combined with emulsions with saturated aqueous phases containing dissolved oxidizer salt. U.S. Pat. No. 3,161,551 discloses a water-in-oil emulsion which was combined with particulate ammonium nitrate so as to fill all the spaces between the solid particles of ammonium nitrate. U.S. Pat. No. 4,111,727 disclosed a composition formed by mixing 10 to 40% of a water-in-oil emulsion containing an oxidizer salt dissolved in the aqueous phase together with 60 to 90% of a solid oxidizer, such as ammonium nitrate, in such a manner that sufficient air is left in the interstitial spaces of the solid oxidizer to render the mixture detonable.

Water-in-oil emulsions containing an oxidizer salt dissolved in the aqueous phase and sensitized by occluded gas, such as glass microballoons, have had mixed into them solid oxidizer salts. For example, U.S. Pat. No. 4,181,546 discloses a waterproof composition containing 40 to 60% by weight of a solid oxidizer salt to the extent to 60 to 40% of a water-in-oil emulsion sensitized by microballoons. See also U.S. Pat. No. 4,509,994.

Mixtures of the solid oxidizer or ANFO with emulsions have varying degrees of stability. Various attempts have been made to improve the stability of explosive compositions utilizing particulate oxidizer salt. In U.S. Pat. No. 4,555,278 the stability of a blend of nitrate particles in a water-in-oil emulsion is thought to be improved by controlling the salt size of the dispersed aqueous phase in the emulsion so as to decrease the chemical driving force between the water and the solid oxidizer. In another approach, in U.S. Pat. No. 4,585,495 the stability of a mixture utilizing solid oxidizer is thought to be improved by utilizing an aqueous slurry having a blend of fuel oil and saturated oxidizer slurries of water-retemptive. In yet another approach, U.S. Pat. No. 4,294,633 discloses a composite mixture in which solid oxidizer particles are combined with a liquid slurry which does not contain water but rather utilizes a low molecular weight polar organic liquid such that the slurry is one that will not appreciably dissolve or soften the solid oxidizer salts.

The industry has constantly sought for improved blasting compositions to provide the most economical explosive having acceptable power output together with desirable handling characteristics. Heretofore the art, when preparing oxidizer solutions for use as the aqueous phase of water-in-oil emulsion, utilized saturated oxidizer solutions. The present invention provides for a very economical product which is easy to manufacture and utilize, while avoiding many of the less desirable characteristics of emulsion having saturated oxidizer solutions.

SUMMARY OF THE INVENTION

In one aspect the invention relates to a composite explosive composition comprising an admixture of solid ammonium nitrate with a water-in-oil emulsion comprising 10 to 80% water by weight of emulsion. The emulsion comprises 0.5 to 5.0% of an emulsifier which is effective to produce a water-in-oil emulsion, 20 to 90% of a water miscible fuel; 2 to 25% of a water immiscible carbonaceous fuel; 10 to 80% water. Optionally the water-in-oil emulsion can include void producing agents such as glass microballoons, and perlite. The emulsion can also contain sensitizers and additional fuels. Explosive compositions are produced by combining about 60 to 90% by weight of a solid oxidizer with 10 to about 40% by weight of the emulsion.

In another aspect the present invention relates to a composite explosive comprising a mixture of a solid oxidizer together with a water-in-oil emulsion. The emulsion comprising from 4 to 60% water; 0.5 to 5.0% of an emulsifier effective to form a water-in-oil emulsion; 20 to 90% of a water miscible fuel; a water immiscible carbonaceous fuel in the amount of from 2 to 25%; and sufficient dissolved oxidizer salts to produce an aqueous phase of the emulsion which is up to abut 75% of saturation at room temperature. The emulsion may also contain void inducing materials, additional fuels, sensitizers, and inorganic perchlorates.

DETAILED DESCRIPTION

The present invention relates to the discovery that a water-in-oil emulsion, which cannot be rendered detonable by incorporating voids into the emulsion, which combined with a solid oxidizer in amounts more than about 60% will form an explosive mixture. A water-in-oil emulsion which cannot be rendered detonable refers to an emulsion which cannot be rendered detonable to initiation by one pound PETN booster when the emulsion is provided with sufficient voids to have a density of less than about 0.9 g/cc. Detonable emulsions were disclosed by Bluhm in U.S. Pat. No. 3,447,978 in which an emulsion with a saturated oxidizer salt solution as the aqueous phase and a carbonaceous fuel forming the continuous phase were rendered detonable by including sufficient occluded gas to reduce the density. Clay in U.S. Pat. No. 4,111,727 discloses that a nonaerated emulsion containing a saturated solution of oxidizer salts making up the aqueous phase when mixed in amounts of from 10 to 40% by weight with 60–90% by weight of a solid particulate oxidizer such that sufficient voids were left unfilled to provide aeration or hot spots to facilitate detonation would produce an explosive composition. The emulsion utilized by Clay, if not mixed with the solid oxidizer, would be detonable if void containing material, such as microballoons, were mixed with the emulsion such that the density was lowered to below about 1.25 gm/cc. Clay discovered, contrary to the teachings in the art, that it was not necessary or the gas to be occluded as finely dispersed bubbles within the emulsion as taught by Bluhm.

It has been discovered that nondetonable water-in-oil emulsions can be utilized to produce an effective explosive.

In the preferred embodiment of the present invention, the emulsion has the general formula. (All percentages herein being weight percents)

| Component | Wt. % | Preferred |
|---|---|---|
| Water | 10 to 80 | 25 to 50 |
| Emulsifier | 0.5 to 5.0 | 0.8 to 1.5 |
| Water immiscible Carbonaceous fuel | 2 to 25 | 10 to 20 |
| Water miscible fuel | 20 to 90 | 25 to 50 |
| Bulking agents | 0 to 6 | 0 to 5 |
| Additional fuels | 0 to 20 | 0 to 5 |
| Sensitizers | 0 to 40 | 0 to 5 |

The resulting water-in-emulsion when formed is an oxidizer-free emulsion indicating that it is prepared without dissolving any oxidizer salts in the aqueous phase. In the preparation of the emulsion, the components may be combined in any appropriate manner to form a water-in-oil emulsion. Preferably, the water miscible fuel is dissolved in water and one step, the emulsifier is dissolved in the water immiscible carbonaceous fuel and in the two are combined to form the emulsion. Thereafter, the emulsion can be mixed with solid oxidizer salts such as ammonium nitrate prills in an amount from about 10 to 40% emulsion with 60 to 90% solid oxidizer.

The emulsifier is any emulsifier which is effective to form a water-in-oil emulsion. Emulsifiers effective to form a water-in-oil emulsion are well known in the art. Examples are disclosed in U.S. Pat. Nos. 3,447,978; 3,715,247; 3,765,964 and 4,141,767 the disclosure of which are hereby incorporated by reference. In addition, acceptable emulsifiers can be found in the reference work McCutcheon's Emulsifiers and Detergents (McCutcheon Division, M.C. Publishing Co., New Jersey). Specific emulsifiers that can be used include those derivable from sorbitol by esterification with removal of water. Such sorbitan emulsifying agents may include sorbitan fatty acid esters such as sorbitan monolaurate, sorbitan monooleate, sorbitan monopalmitate, sorbitan monostearate and sorbitan tristerate. The mono- and glycerides of fat-forming fatty acids are also useful as emulsifying agents. Other emulsifying agents which may be used in the present invention include polyoxyethylene sorbitol esters such as the polyoxyethylene sorbitol beeswax derivative materials. Water-in-oil type emulsifying agents such as the isopropyl esters of lanolin fatty acids may also prove useful as may mixtures of higher molecular fatty alcohols and wax esters. Various other specific examples of water-in-oil type emulsifying agents include polyoxyethylene lauryl ether, polyoxyethylene oleyl ether, polyoxyethylene stearyl ether, polyoxyalkylene and oleyl laurate, oleyl acid phosphates, substituted oxazolines and phosphates esters, to list but a few. Mixtures of these various emulsifying agents as well as other emulsifying agents may also be used. A sufficient amount of emulsifier is used to maintain the stability of the emulsion when it is admixed with the solid oxidizer.

The carbonaceous water immiscible fuel is a fuel which is flowable to produce a continuous phase of an emulsion. The carbonaceous fuel component can include most hydrocarbons, for example, paraffinic, olefinic, naphthenic, aromatic, saturated or unsaturated hydrocarbons. Suitable water immiscible carbonaceous fuels include diesel fuel oil, mineral oil, paraffinic waxes, microcrystalline waxes, and mixtures of oil and waxes. Preferably, the carbonaceous water immiscible fuel is diesel fuel oil because it is inexpensive and flows easily. Suitable oils useful in the compositions of the present invention include the various petroleum oils, vegetable oils, and mineral oils, e.g. a highly refined white mineral oil sold by White's Chemical Company, Inc. under trade designation Kaydol and the like. Waxes are preferably used in combination with oils and generally heating is required in order to dissolve the wax and oil together. Utilization of wax typically results in an emulsion which is more viscous then when mineral oil or diesel fuel oil or other light hydrocarbon oil is utilized. Suitable waxes such as petroleum wax, microcrystalline wax, paraffin wax, mineral waxes such as oxocerite and montan wax, animal waxes such as spermacetic wax and insect waxes such as beeswax and chinese wax can be used in accordance with the present invention.

The water miscible fuel is preferably one which is readily dissolved or miscible in water for ease of manufacture and to save expense. The preferred water miscible fuel is urea because it is inexpensive and easily dissolved in water. Other water miscible fuels which may be utilized are methanol, ethanol, ethylene glycol, formamide and other lower alcohols. It is recognized that some water miscible fuels as commercially available may contain water, for example, ethanol from commercial sources can contain up to approximately 10% water which is accounted for by making appropriate computations. In addition amines and amides for example formamide can also be used as well as other low molecular weight nitrogen containing molecules. Other so called organic (i.e., carbon containing) materials such as polyethylene glycols and carbohydrates (sugars), amino acids, carboxylic acids, soluble ketones and ethers may also be used.

The additional fuels can be those known in the art such as finely divided coal, aluminum flakes, aluminum granules, ferrophorous, sugar, silicon, magnesium and sulfur. Generally any of the fuels known in the art can be used.

Sensitizers suitable for use with the present invention include monomethyl amine nitrate, TNT, PETN, smokeless powder, and others known in the art. Sensitizers are employed to increase sensitivity to detonation but usually will not be added because they are expensive. Bulking agents are agents which reduce the density of the emulsion and may optionally be added. Bulking agents may also serve to sensitize the total composition. Any suitable bulking agents may be used including those known in the art such as glass or resin microballoons, styrofoam beads and perlite. The bulking agent can also be occluded gas which is retained in the emulsion and is either whipped into the emulsion or generated by use of gassing agents such as thiourea together with sodium nitrite.

The formulated emulsion is then combined with solid oxidizer salts. The preferred solid oxidizer is ammonium nitrate in prill form. Preferably, the solid oxidizer is industrial grade ammonium nitrate. The solid oxidizer salts also include sodium nitrate, and/or calcium nitrate. Of course, these oxidizer salts can be utilized in combination with ammonium nitrate and when they are utilized it is preferable that they are in combination with ammonium nitrate and that ammonium nitrate be present as the principal solid oxidizer salt. The solid oxidizer while preferably in prill form but can be in flake, ground or other forms. ANFO although not commonly called a solid oxidizer salt is also considered a solid oxidizer for purposes of this description.

It has been found that the amount of emulsion which can be usefully employed with the solid oxidizer salt can vary depending upon the size of the borehole, the form and composition of the solid oxidizer component and whether bulking agents or sensitizers are utilized in the emulsion. In general, the amount of emulsion preferably utilized is from about 10% to about 35%. In larger diameter boreholes such as above 10" in diameter it has been found that up to about 40% emulsion can be utilized in the compositions. In smaller diameter boreholes in the range of 3 to 6" it is desirable to utilize from 10 to about 25% emulsion and it has been from that the employment of bulking agents in the smaller diameters is desirable to enhance performance. Table 1 sets forth compositions illustrating the present invention, utilizing an oxidizer free aqueous phase in the emulsion.

Relative energy values (RBS) have been included in Table I to demonstrate the increase in energy obtainable using the present invention. These values should be compared to ANFO which would have a value of 100. Oxygen balance (OB) values have also been included to show that the examples have not been optimized with regard to energy output. An OB of O is expected to give maximum energy output. The further from O of course the poorer is the balance between available oxygen and fuel and the lower the expected energy output. The ANFO standard used for comparison has an OB of about O. It can be seen from the results presented that even nonoptimal systems such as Example V give energy increases over ANFO.

TABLE I

| | I | II | III | IV | V |
|---|---|---|---|---|---|
| 1. Explosive Composition by weight percent | | | | | |
| a. emulsion | 27 | 10 | 20 | 20 | 20 |
| b. AN prills | 73 | 90 | 80 | 80 | 80 |
| Density of composite (g/cc) | 0.96 | 0.95 | 1.07 | 1.12 | 1.08 |
| Detonation Velocity[1] | 2450 | 3180 | 1340 | 1150 | 2340 |
| Charge diameter | 5" | 6" | 6" | 6" | 6" |
| 2. Emulsion Composition of 1(a) by weight percent of emulsion | | | | | |
| a. urea | 39 | 40 | 40 | — | — |
| b. ethylene glycol | — | — | — | 40 | 60 |
| c. water | 39 | 40 | 40 | 40 | 20 |
| d. sorbitan monooleate[2] | — | 5 | 5 | 5 | 5 |
| e. DMHTD[3] | 5.2 | — | — | — | — |
| f. HCl[3] | 1.8 | — | — | — | — |
| g. Diesel Fuel Oil | 15 | 15 | 15 | 15 | 15 |
| 3. Relative Bulk Strength[4] | 81 | 80 | 106 | 113 | 110 |
| 4. Oxygen Balance[5] | −12.3 | 8.3 | −3.0 | −6.9 | −12.1 |

[1]Velocity in m/sec
[2]emulsifier
[3]DMHTD and HCl were mixed to form an emulsifier.
[4]Energy output in calories/cubic centimeters as compared to ANFO at 0.81 grams/cubic centimeter.
[5]Grams of oxygen minus grams of fuel per 100 grams of explosive In another embodiment the present invention relates to utilizing an unsaturated aqueous solution of oxidizer salt such as ammonium nitrate in the aqueous phase of a water-in-oil emulsion which also contains a water miscible fuel. The general formula of these emulsions is:

| COMPONENT | WT. % | PREFERRED WT % |
|---|---|---|
| Water | 4 to 60 | 25 to 50 |
| emulsifier | 0.5 to 5.0 | 0.8 to 1.5 |
| water immiscible carbonaceous fuel | 2 to 25 | 10 to 20 |
| water miscible fuels | 20 to 90 | 25 to 50 |
| inorganic nitrates | 6 to 60 | 6 to 30 |
| inorganic perchlorates | 0 to 30 | 0 to 5 |

The inorganic nitrates can be any oxidizing salt such as ammonium nitrate, sodium nitrate or calcium nitrate. The amount of inorganic nitrate and/or inorganic perchlorate is such that the aqueous solution will be up to 75% saturated at room temperature with the oxidizer salts. Preferably, the aqueous solution is 10 to 50% saturated at room temperature. This aqueous solution of oxidizer and the water miscible fuels form the discontinuous phase of the emulsion. The organic perchlorates can be any of those known in the art such as ammonium perchlorate, sodium perchlorates or combinations thereof.

Emulsion can be formed by any method known in the art. Preferably it is formed by dissolving the water soluble fuel with the water and admixing the emulsifier separately with the water immiscible carbonaceous fuel. The aqueous solution can be heated to speed dissolving of the nitrates. The two mixtures prepared are then mixed together to form the emulsion. Thereafter, the emulsion is added to the solid oxidizer which is preferably ammonium nitrate prills. The solid oxidizer can be sodium nitrate, calcium nitrate or a combination of oxidizing salts. If a combination of oxidizing salts is utilized it is preferable that the principal oxidizer salt is ammonium nitrate. ANFO although not commonly referred to as solid oxidizer salt is also considered a solid oxidizer for purposes of this description. Emulsion levels of from 10 to 35% by weight can be utilized with about 65 to 90% by weight of the solid oxidizer salt. In general, the upper limit of emulsion which can be used increases as the borehole diameter increases. Surprisingly, we found that when the emulsion does not contain any dissolved oxidizer more emulsions can be used. This was contrary to expected results.

The resulting composite explosive resulting from combination of the oxidizer salt with the emulsion can be prepared on site, delivered to on site with a bulk truck or can be packaged in a suitable container such as a polyethylene bag.

Table 2 sets forth exemplary compositions containing oxidizer salt dissolved in the aqueous phase of the emulsion. Relative energy and OB values have been included in Table II as in Table I to illustrate energy improvements obtainable using the present invention even in nonoptimal systems. Example I shows a system that is reasonably close to optimized and yields about a 20% increase in available energy over that obtainable from optimized ANFO.

TABLE II

| | I | II | III |
|---|---|---|---|
| 1. Explosive Composition by weight percent of composition | | | |
| a. emulsion | 20 | 20 | 30 |
| b. AN prills | 80 | 80 | 70 |
| density g/cc | 1.03 | 1.04 | 1.11 |
| Detonation Velocity[1] | 2990 | 2820 | LOD |
| Charge diameter | 6" | 6" | 6" |
| 2. Emulsion Composition of 1(a) by weight percent of emulsion | | | |
| a. urea | 30 | — | — |
| b. ethylene glycol | — | 30 | 30 |
| c. water | 20 | 20 | 20 |
| d. sorbitan monooleate | 5 | 5 | 5 |
| e. diesel fuel oil | 15 | 15 | 15 |
| f. ammonium nitrate | 30 | 30 | 30 |
| g. % of saturation of the aqueous phase at room temperature | 46 | 60 | 60 |
| 3. Relative Bulk Strength[2] | 118 | 116 | 116 |
| 4. Oxygen Balance[3] | −0.2 | −3.2 | −14.6 |

[1]Detonation velocity in meters per second unconfined in 6" diameter, LOD indicates low order detonation.
[2]Energy output in calories/cubic centimeters as compared to ANFO at 0.81 g/cc.
[3]Grams of oxygen minus grams of fuel per 100 grams of explosive While the present invention has been described in terms of the certain preferred embodiment other variations will be apparent.

What is claimed is:

1. An explosive composition comprising:
(a) 60 to 90% of a solid oxidizer; and
(b) 10 to 40% emulsion consisting essentially of
(i) 10 to 80% water
(ii) 0.5 to 5.0% of an emulsifier effective to form a water-in-oil emulsion
(iii) 2 to 25% of a water immiscible carbonaceous fuel
(iv) 20 to 90% of a water miscible fuel.

2. The composition of claim 1 wherein said emulsion further comprises from 0 to 6% bulking agents; 0 to 20% percent additional fuels; and 0 to 40% sensitizers.

3. Explosive composition of claim 1 wherein said solid oxidizer is selected from the group consisting of ANFO (ammonium nitrate-fuel oil), ammonium nitrate, sodium nitrate, calcium nitrate and mixtures thereof.

4. The explosive composition of claim 1 wherein said water miscible fuel is selected from the group consisting of, urea, methanol, propanol, formamide, ethylene glycol, and mixtures thereof.

5. The explosive composition of claim 1 wherein said emulsion is 10to 35%.

6. An explosive composition comprising:
(a) 70 to 90% solid oxidizer salt; and
(b) 10 to 30% by weight of an emulsion consisting essentially of:
(i) 4 to 60% water;
(ii) 0.5 to 5.0% of an emulsifier effective to form a water-in-oil emulsion;
(iii) 2 to 25% of a water immiscible carbonaceous fuel;
(iv) 20 to 90% water miscible fuels;
(v) 6 to 60% inorganic nitrate dissolved within said water such that the aqueous solution of water and inorganic nitrate is less than a 75% saturated aqueous solution at room temperature.

7. The composition of claim 6 further comprises said emulsion further comprises from 0 to 6% bulking agents; 0 to 20% percent additional fuels; and 0 to 40% sensitizers.

8. Explosive composition of claim 6 wherein said solid oxidizer is selected from the group consisting of ANFO (ammonium nitrate-fuel oil), ammonium nitrate, sodium nitrate, calcium nitrate and mixtures thereof.

9. The explosive composition of claim 6 wherein said water miscible fuel is selected from the group consisting of, urea, methanol, propanol, formamide, ethylene glycol, and mixtures thereof.

* * * * *

UNITED STATES PATENT AND TRADEMARK OFFICE

CERTIFICATE OF CORRECTION

PATENT NO. : 4,872,929

DATED : October 10, 1989

INVENTOR(S) : Mullay

It is certified that error appears in the above-identified patent and that said Letters Patent is hereby corrected as shown below:

Column 3, line 47, delete "which" and insert therefore --when--.

Column 4, line 5, delete "or" and insert therefore --for--.

Column 4, line 65, delete "phosphates" (second occurrence) therefore --phosphate--.

Column 8, line 43, delete "10to" and insert therefore --10 to--.

Signed and Sealed this

Twenty-seventh Day of October, 1992

*Attest:*

DOUGLAS B. COMER

*Attesting Officer*

*Acting Commissioner of Patents and Trademarks*